US007616080B2

(12) United States Patent
Yoo et al.

(10) Patent No.: US 7,616,080 B2
(45) Date of Patent: Nov. 10, 2009

(54) BANDPASS FILTER

(75) Inventors: Chan-sei Yoo, Anyang-si (KR); Woo-sung Lee, Seongnam-si (KR); Dongsu Kim, Seongnam-si (KR); Nam-kee Kang, Seoul (KR); Jong-chul Park, Seongnam-si (KR)

(73) Assignee: Korea Electronics Technology Institute, Gyonggi-Do (KR)

( * ) Notice: Subject to any disclaimer, the term of this patent is extended or adjusted under 35 U.S.C. 154(b) by 211 days.

(21) Appl. No.: 11/515,305

(22) Filed: Sep. 1, 2006

(65) Prior Publication Data

US 2007/0285193 A1 Dec. 13, 2007

(30) Foreign Application Priority Data

Jun. 8, 2006 (KR) ..... 10-2006-0051445

(51) Int. Cl.
*H01P 1/203* (2006.01)

(52) U.S. Cl. ..... 333/204; 333/185

(58) Field of Classification Search ..... 333/202–205, 333/25, 185

See application file for complete search history.

(56) References Cited

U.S. PATENT DOCUMENTS 5,248,949 A * 9/1993 Eguchi et al. ..... 333/204
5,608,364 A * 3/1997 Hirai et al. ..... 333/204
6,191,666 B1 * 2/2001 Sheen ..... 333/185
6,794,961 B2 * 9/2004 Nagaishi et al. ..... 333/247
6,822,534 B2 * 11/2004 Uriu et al. ..... 333/185
6,965,285 B2 * 11/2005 Hirabayashi ..... 333/205
7,064,632 B2 * 6/2006 Buck et al. ..... 333/204
7,312,676 B2 * 12/2007 Kundu ..... 333/204
2006/0192637 A1 * 8/2006 Urano et al. ..... 333/204
2007/0279145 A1 * 12/2007 Kimura et al. ..... 333/25

* cited by examiner

*Primary Examiner*—James H. Cho
*Assistant Examiner*—Crystal L Hammond
(74) *Attorney, Agent, or Firm*—Ober/Kaler; Royal W. Craig

(57) ABSTRACT

A bandpass filter (BPF) configured in 3-D structures for filtering signals of ultra wide bands is disclosed, the BPF comprising sequentially stacked first to fourth dielectric substrates, wherein the first dielectric substrate is formed at a bottom surface thereof with a first ground pattern, the second dielectric substrate is formed at an upper surface thereof with a second ground pattern, and a stripline pattern is formed between the first and second dielectric substrates. The fourth dielectric substrate is formed thereon with a filter pattern and input/output coupled line patterns.

12 Claims, 6 Drawing Sheets

BANDPASS FILTER

CROSS-REFERENCE TO RELATED APPLICATIONS

The present application derives priority from Korean Patent Application Serial No. 10-2006-0051445 filed 8 Jun. 2006.

BACKGROUND OF THE INVENTION

1. Field of the Invention

The present invention relates to a bandpass filter (BPF) for filtering a signal of ultra wide band (UWB).

2. Description of the Invention

Generally, UWB (Ultra Wide Band) communication technology is capable of transmitting a large quantity of data through a broad frequency spectrum at a high data transmission rate with low power consumption within a limited range. The UWB communication employs an ultra wideband signal having a broad frequency bandwidth in the range of GHz for transmitting a predetermined data, and can transmit at a high data transmission rate from 100 Mbps to 1 Gbps. The UWB communication is expected to solve the communication frequency shortage problem because it can transmit data on instantaneous short pulses at a high data transmission rate through a broad frequency spectrum.

In addition to the advantage of the high data transmission rate, the UWB communication still has another merit in that its power consumption is at most 1/10 of a power necessary for implementing communications in communication products such as cellular phones and wireless local area networks (WLANs). The UWB communication is widely used for a wide variety of terminals such as cellular phones, personal communication services and wideband code division multiple access (WCDMA), and it is necessary to miniaturize parts for BPFs employed by the UWB communication.

There are available wide ranges of BPFs used for the UWB communication. However, there is a problem in the most of the BPFs manufactured with microstrip patterns being formed on a surface of a dielectric substrate in that the BPF has a narrow stop band and is too big in size for application in products.

SUMMARY OF THE INVENTION

It is an object of the present invention to provide a BPF configured to fabricate three dimensional (3D) patterns on a plurality of dielectric substrates to embody a feature of filtering ultra wideband signals and realizing the miniaturization thereof.

Another object is to provide a BPF having a wide stop band.

In accordance with the object of the invention, a BPF uses a plurality of dielectric substrates, and fabricates 3D patterns on the plurality of dielectric substrates. The 3D patterns comprises: first and second ground patterns; a stripline pattern formed between the first and second ground patterns; a substantially oblong filter pattern connected to the stripline pattern through a via; and input/output coupled line patterns for inputting and outputting a signal to be filtered by the filter pattern.

The filter pattern is formed on a top surface of the dielectric substrate, and the dielectric substrate is formed with the input/output coupled line patterns. The input coupled line pattern is respectively formed with first and second stripline patterns each having an overlapping area on a top surface and a bottom surface of the dielectric substrate, and the second stripline pattern is connected to the filter pattern through the via. The output coupled line pattern is respectively formed with third and fourth stripline patterns, each having an overlapping area on the top surface and the bottom surface of the dielectric substrate, and the third stripline pattern is connected to the filter pattern.

The BPF according to the present invention comprises: a first dielectric substrate formed at a bottom surface thereof with a first ground pattern; a second dielectric substrate laminated on a top surface of the first dielectric substrate and formed thereon with a second ground pattern; a stripline pattern formed between the first dielectric substrate and the second dielectric substrate; a third dielectric substrate laminated on the top surface of the second dielectric substrate; and a fourth dielectric substrate laminated on a top surface of the third dielectric substrate, formed thereon with a filter pattern to be connected to the stripline pattern through a via, and formed at both right and left sides thereof with input/output coupled line patterns to be connected to the filter pattern.

Furthermore, the BPF according to the present invention comprises: a first dielectric substrate formed at a bottom surface thereof with a first ground pattern; a second dielectric substrate laminated on a top surface of the first dielectric substrate and formed thereon with a second ground pattern; a stripline pattern formed between the first dielectric substrate and the second dielectric substrate; a third dielectric substrate laminated on the top surface of the second dielectric substrate, formed thereon with a filter pattern, and formed at both right and left sides of the filter pattern with a ground pattern; a fourth dielectric substrate laminated on a top surface of the third dielectric substrate; and a fifth dielectric substrate laminated on a top surface of the fourth dielectric substrate, and formed at both right and left sides thereof with input/output coupled line patterns to be connected to the filter pattern.

BRIEF DESCRIPTION OF THE DRAWINGS

Other features, elements, steps, characteristics, and advantages of the present invention will become more apparent from the following description of preferred embodiments of the present invention with reference to the attached drawings.

DETAILED DESCRIPTION OF THE INVENTION

Hereinafter, preferred embodiments of the present invention will be described in detail with reference to the accompanying drawings, where in the description of the instant invention, if it is determined that related known arts or detailed description of the construction may unnecessarily obscure the subject matter of the instant invention, detailed description thereto will be omitted.

Figure 1:
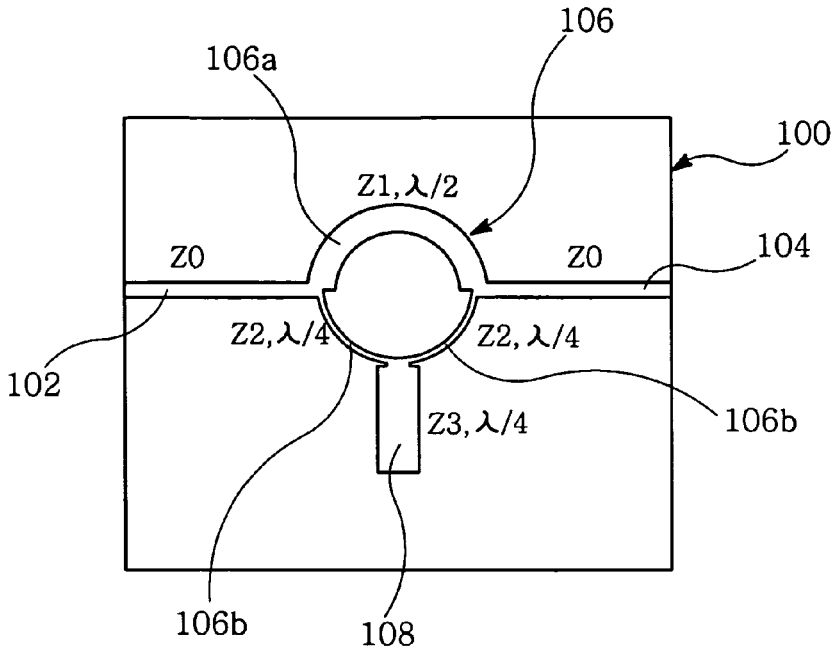
FIG. 1 is a general concept of a bandpass filter (BPF) according to prior art.

FIG. 1 is a general concept of a bandpass filter (BPF) according to prior art, where reference numeral 100 denotes a dielectric substrate. The dielectric substrate 100 is formed at an entire bottom surface thereof with a ground pattern (not shown).

Reference numeral 102 represents an input pattern, and 104 refers to an output pattern. Each of the input and output patterns' 102 and 104 has a predetermined characteristic impedance ($Z_0$). Between the input pattern 102 and the output pattern 104 there is formed a ring-shaped filter pattern 106. The filter pattern 106 is composed of an upper pattern 106*a* and a lower pattern 106*b*, and the lower pattern 106*b* is disposed at a middle section thereof with a stub 108.

The upper pattern 106*a* has a length of λ/2 (where, λ is a wavelength of usage frequency), and its line width is so formed as to be thicker than that of the lower pattern 106*b*, thereby having a characteristic impedance of $Z_1$. A line width of the lower pattern 106*b* is thinner than that of the upper pattern 106*a*. A length between the input pattern 102 and the stub 108, and a length between the stub 108 and the output pattern 104 are respectively of λ/4 to have a characteristic impedance of $Z_2$. A length of the stub 108 is given as λ/4 to have a characteristic impedance of $Z_3$.

The bandpass filter thus constructed is determined of its passband by a mutual ratio among the characteristic impedance ($Z_1$) of the upper pattern 106*a*, the characteristic impedance ($Z_2$) of the lower pattern 106*b* and the characteristic impedance ($Z_3$) of the stub 108.

Figure 2:
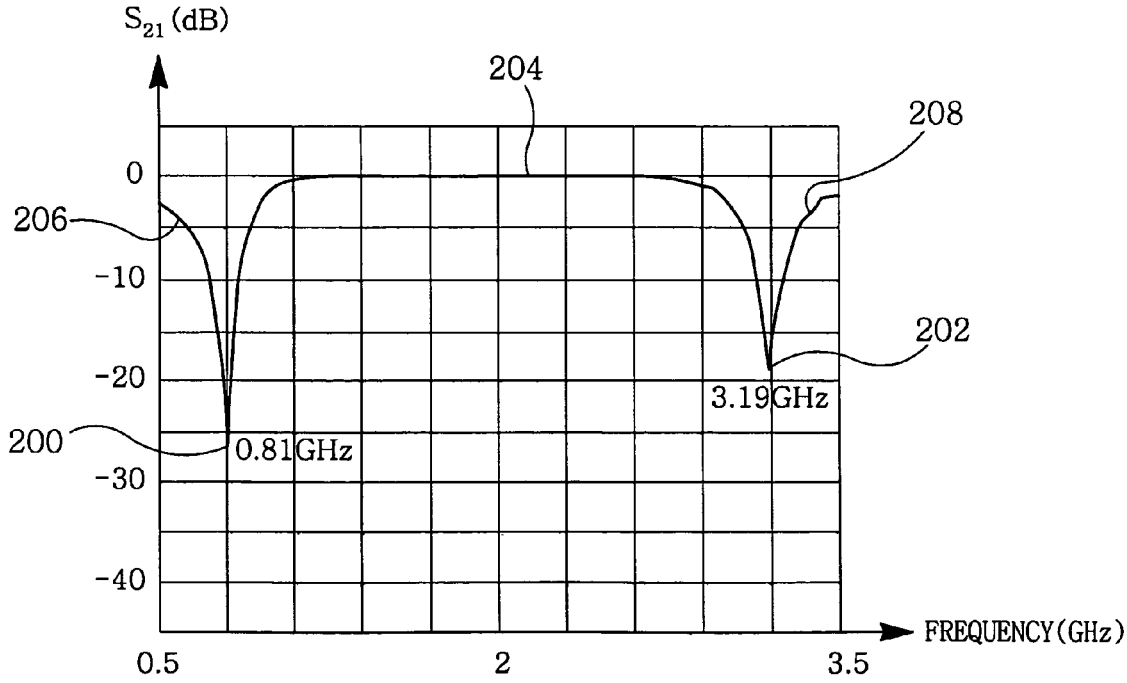
FIG. 2 is a graph illustrating a measurement of a transfer characteristic $S_{21}$ of the BPF in FIG. 1.

Referring now to FIG. 2, a bandpass filter is determined of its passband by positions of poles 200 and 202. A transfer characteristic $S_{21}$ of the BPF of FIG. 1 is shown as per the Equation 1 below.

$$S_{21} = \frac{\left(-Z_0 Z_1 Z_2^3(\tan^2\theta + 1)\left(\tan^2\theta - \frac{2Z_3(Z_1 + Z_2)}{Z_2^2}\right)\right.}{[Z_1 Z_2 j\tan\theta + Z_0(Z_1 + Z_2)]}$$
$$[-Z_0 Z_2^2 j\tan^3\theta + Z_0(Z_1 Z_2 + 2Z_3(Z_1 + Z_2))j\tan\theta + 2Z_1 Z_2 Z_3]$$

where, $\theta$ is $\lambda/4$.

EQUATION 1

If the transfer characteristic $S_{21}$ in Equation 1 is zero, it corresponds to frequencies of the poles 200 and 202. In order for the transfer characteristic $S_{21}$ in Equation 1 to be zero, a denominator of the following Equation 2 should be zero.

$$\tan^2\theta - \frac{2Z_3(Z_1 + Z_2)}{Z_2^2} = 0$$

EQUATION 2

The Equation 2 can be simplified as Equation 3

$$\tan^2\theta = 2\left(1 + \frac{Z_1}{Z_2}\right)\frac{Z_3}{Z_2}$$

EQUATION 3

As noted in Equation 3, positions of the poles 200 and 202 are determined by an impedance ratio between $Z_1/Z_2$ and $Z_3/Z_2$.

However, as illustrated in FIG. 2, the BPF is very narrow at stop band width thereof, such that unwanted passbands 206 and 208 are generated about a passband 204, making it difficult to be used as a BPF of wideband.

Figure 3:
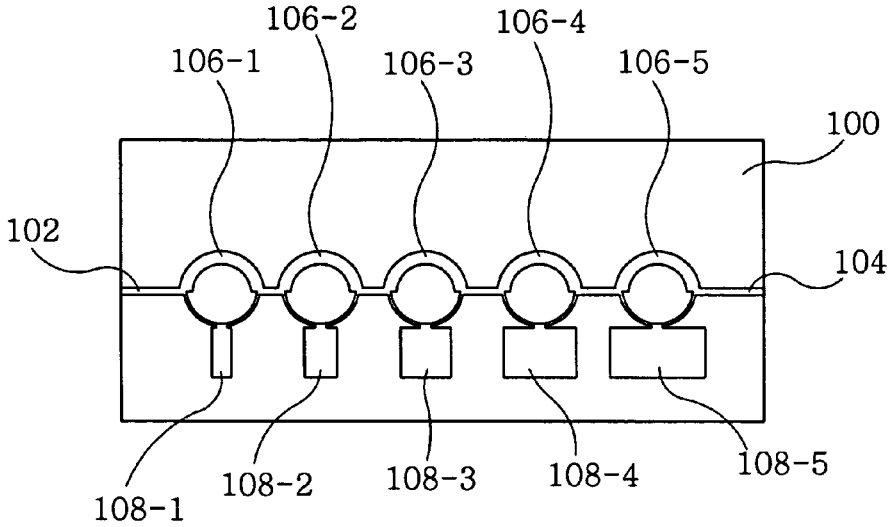
FIG. 3 is a schematic diagram illustrating an exemplary use of the BPF of FIG. 1.

In order to solve the aforementioned problem, the dielectric substrate 100 is formed in series with a plurality of filter patterns (106-1~106-5), as illustrated in FIG. 3. Each filter pattern (106-1~106-5) is formed with stubs (108-1~108-5) with each stub having a different width, such that each stub (108-1~108-5) can have a different characteristic impedance. The characteristic impedance $Z_3$ of each stub (108-1~108-5) is, for example, 21.6Ω, 15.6Ω, 11.7Ω, 9.1Ω and 7.6Ω.

The stop band width of the BPF can be widened as the plurality of filter patterns (106-1~106-5) are formed in series, and each stub (108-1~108-5) formed at each filter pattern (106-1~106-5) has a different characteristic impedance.

Figure 4:
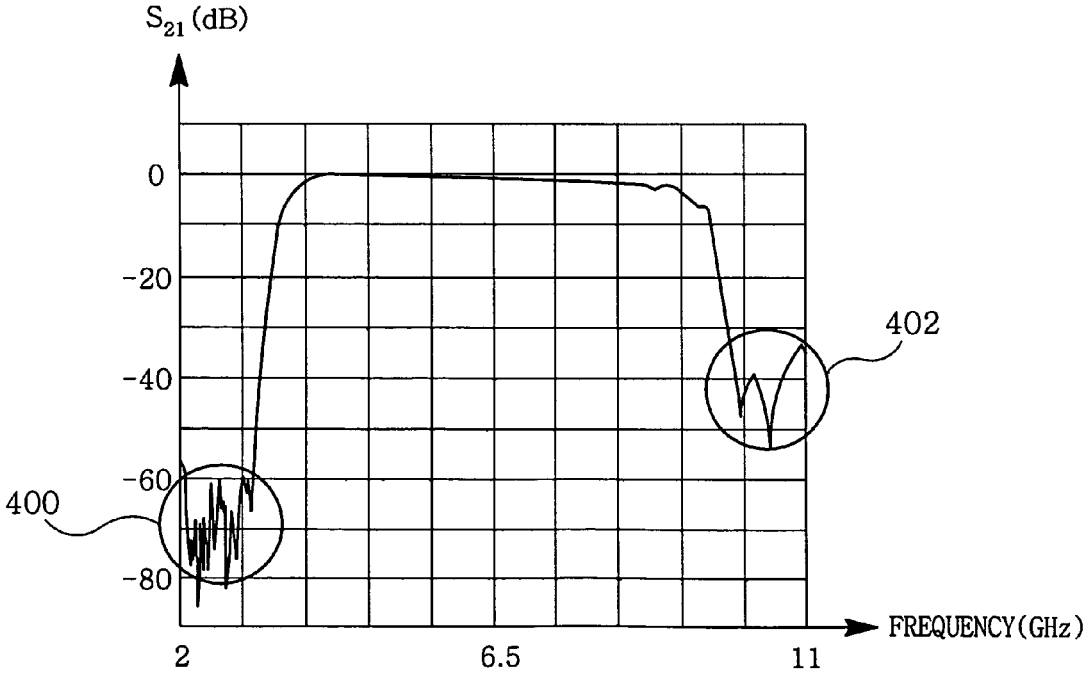
FIG. 4 is a graph illustrating a measurement of a transfer characteristic $S_{21}$ of the BPF in FIG. 3.

FIG. 4 is a graph illustrating a measurement of a transfer characteristic $S_{21}$ of the BPF in FIG. 3.

As seen in FIG. 4, the plurality of filter patterns (106-1~106-5) are formed in series, and each stub (108-1~108-5) formed at each filter pattern (106-1~106-5) is so formed as to have a different characteristic impedance, such that widths of stop bands 400 and 402 can be widened, making it possible to be used as BPF.

However, there is a disadvantage in the formation of the plurality of filter patterns (106-1~106-5) in series in that the BPF becomes big-sized because the plurality of filter patterns (106-1~106-5) are horizontally formed on the dielectric substrate 100 although the stop band width is widely expanded.

Figure 5:
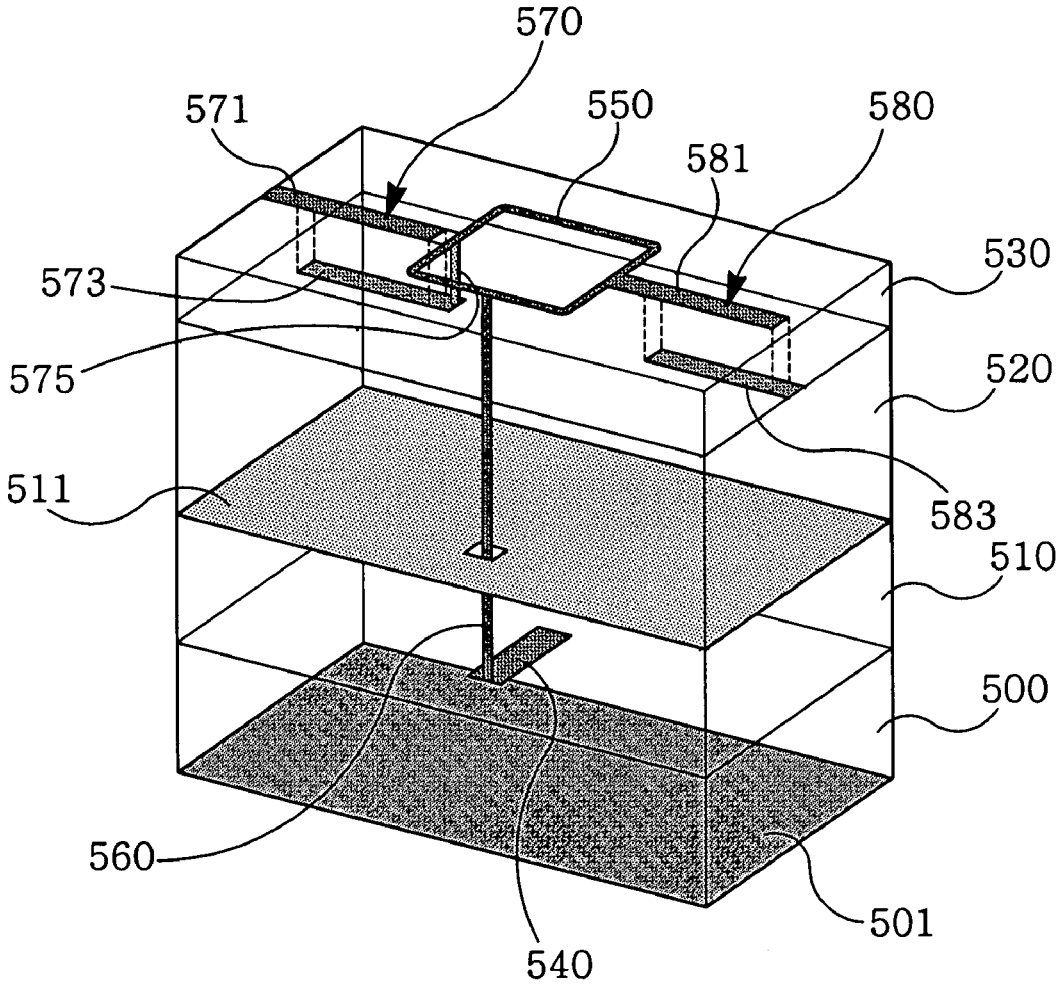
FIG. 5 is a perspective view of a construction of a BPF according to a first embodiment of the present invention.

FIG. 5 is a perspective view of a construction of a BPF according to a first embodiment of the present invention.

Referring to FIG. 5, the BPF according to the present invention is constructed in such a manner that first to fourth dielectric substrates (500, 510, 520, 530) are sequentially laminated. The first dielectric substrate 500 is formed at a bottom surface thereof with a first ground pattern 501, and the second dielectric substrate 510 is formed at an upper surface thereof with a second ground pattern 511. The second ground pattern 511 may be formed at a bottom surface of the third dielectric substrate 520.

Between the first dielectric substrate 500 and the second dielectric substrate there is formed a stripline pattern 540. The stripline pattern 540 may be formed on an upper surface of the first dielectric substrate 500, or on a bottom surface of the second dielectric substrate 510.

Furthermore, the fourth dielectric substrate 530 is formed on an upper surface thereof with a substantially rectangular microstrip line-structured filter pattern 550, and the filter pattern 550 is connected to the stripline pattern 540 through a via 560. The fourth dielectric substrate 530 is formed at both sides thereof with input and output coupled line patterns 570 and 580 for broadening the passband and the stop band at the same time.

The input coupled line pattern 570 is formed at an upper surface and a bottom surface of the fourth dielectric substrate 530 with first and second stripline patterns 571 and 573 for making available an overlapping area therebetween, and the second stripline pattern 575 is connected to the filter pattern 550 through a via 575.

The output coupled line pattern 580 is formed at an upper surface and a bottom surface of the fourth dielectric substrate 530 with third and fourth stripline patterns 581 and 583, and the third stripline pattern 581 is connected to the filter pattern 550.

The BPF thus configured according to the present invention is such that the filter pattern 550 is formed in the shape of microstrip line structure, and the stripline pattern 540 forms a stub. The stub should be so embodied as to have a low impedance. In the instant invention, because the stripline pattern 540 embodies the stub, it is easy to embody the stripline pattern 540 having a low impedance. Furthermore, the stripline pattern 540 is formed between the first and second dielectric substrates 500 and 510 comprising the BPF to enable to reduce the size of the BPF.

The fourth dielectric substrate 530 is formed at a left side thereof with the input coupled line pattern 570 including the first and second stripline patterns 571 and 573 through which a signal to be filtered is inputted, and the fourth dielectric substrate 530 is formed at a right side thereof with the third stripline pattern 581 including the third and fourth stripline patterns 581 and 583 through which a signal filtered by the filter pattern 550 is outputted.

A signal of a predetermined frequency inputted into the first stripline pattern 571 of the input coupled line pattern 570 is transmitted to the second stripline pattern 573, and the signal transmitted to the second stripline pattern 573 is introduced into and filtered by the filter pattern 550 via the via 575. The signal filtered by the filter pattern 550 is transmitted to the fourth stripline pattern 583 and outputted by the third stripline pattern 581 of the output coupled line pattern 580.

Therefore, the present invention has an advantage in that the transfer characteristic of the filter pattern 550 can be improved because the signal filtered by the input coupled line pattern 570 and the output coupled line pattern 580 is inputted and outputted to make a passband broad, and to allow forming a broad stop band at low and high frequencies.

The first and second stripline patterns 571 and 573 comprising the input coupled line pattern 570, and the third and fourth stripline patterns 581 and 583 comprising the output coupled line pattern 580 are vertically laminated, thereby enabling to adjust a frequency of the passband according to the line width and length of the overlapped area.

Figure 6:
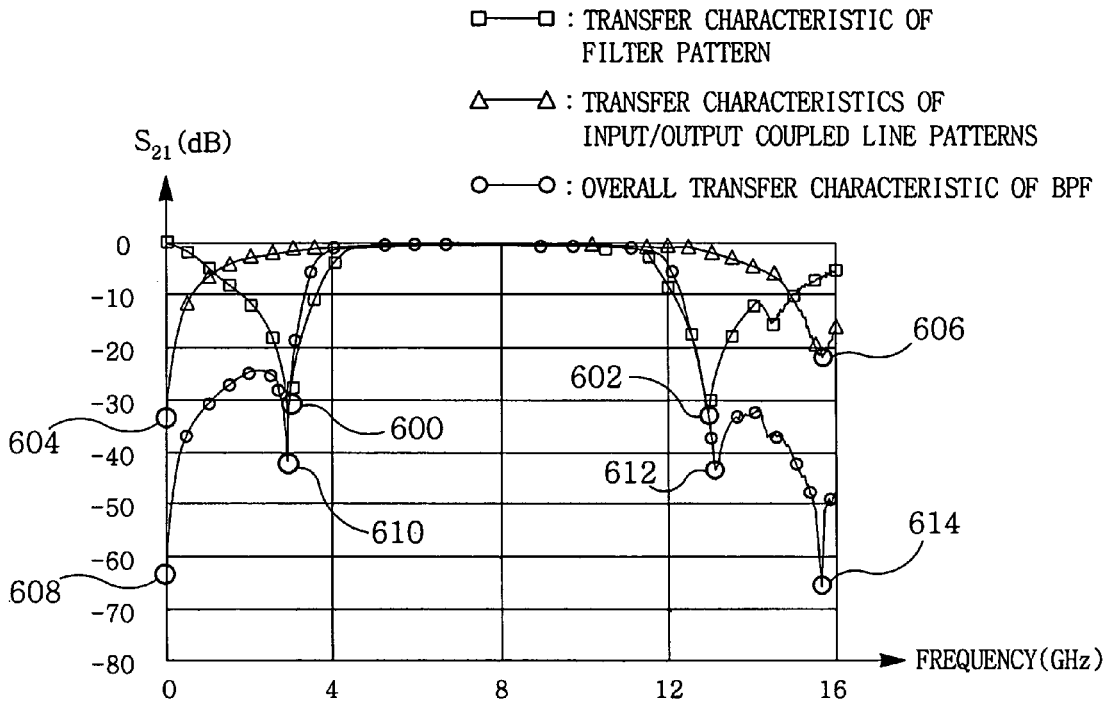
FIG. 6 is a graph illustrating a measurement of a transfer characteristic $S_{21}$ of the BPF according to the first embodiment of the present invention.

In the BPF thus configured according to the present invention, the transfer characteristic of the filter pattern 550 to which the stripline pattern 540 is connected, and each transfer characteristics of the input and output coupled line patterns 570 and 580 were measured to obtain a result shown in FIG. 6.

Referring to FIG. 6, the transfer characteristic of the filter pattern 550 to which the stripline pattern 540 is connected in the BPF according to the present invention has a very narrow stop band. Each input and output coupled line patterns 570 and 580 has poles 604 and 606, where the pole 604 has a frequency lower than that of a pole 600 at the filter pattern 550, and the other pole 606 has a frequency higher than that of a pole 602 at the filter pattern 550.

The entire transfer characteristic of the BPF according to the present invention is a combination in which the transfer characteristic of the filter pattern 550 to which the stripline pattern 540 is connected, and each transfer characteristic of the input and output coupled line pattern 570 and 580 are combined, having a total of 4 poles 608, 610, 612 and 614, such that it can be noted that the stop band width is broadly formed, resulting in formation of a wider stop band width and a wider smoother passband.

Figure 7:
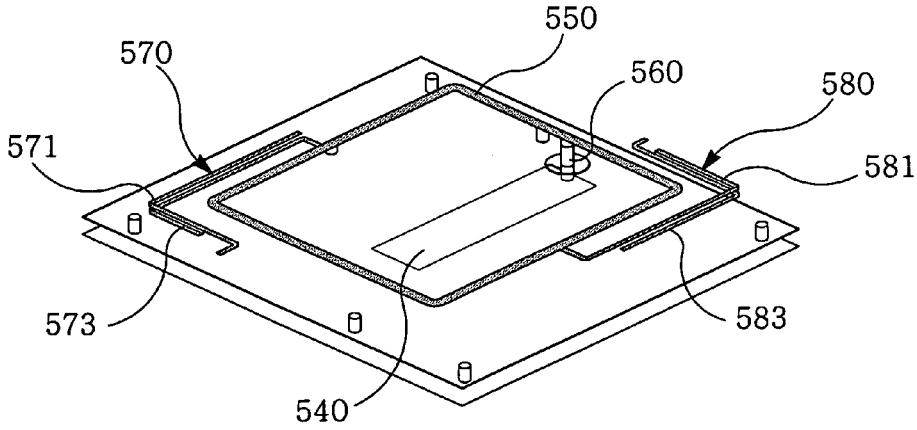
FIG. 7 is a perspective view of a construction of a BPF according to a second embodiment of the present invention.

In the BPF according to the present invention, the first and second stripline patterns 571 and 573 of the input coupled line pattern 570 and the third and fourth stripline patterns 581 and 583 of the output coupled line pattern 580 may be formed bent along the peripheral margin of the filter pattern 550 as shown in FIG. 7. The size of BPF can be much reduced if the first and second stripline patterns 571 and 573, and the third and fourth stripline patterns 581 and 583 are formed bent along the peripheral margin of the filter pattern 550.

In the BPF according to the present invention, areas of the stripline pattern 540 and filter pattern 550, and dielectric constant of the dielectric substrates were made to be variable to measure a transfer characteristic of the filter pattern 550 to which the stripline pattern 540 is connected.

Figure 8A:
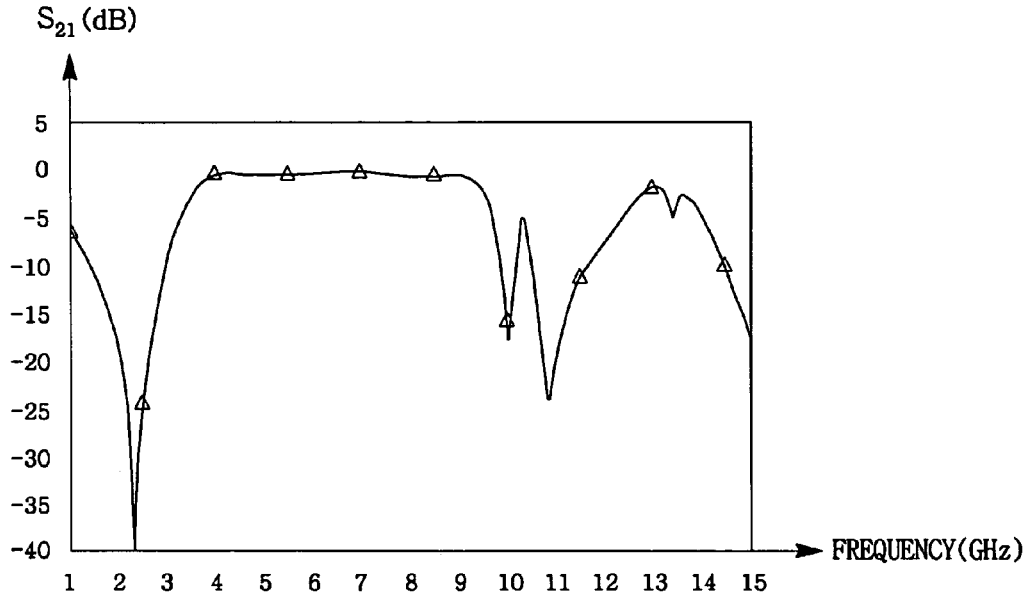
FIG. 8*a* is a graph illustrating a measurement of a transfer characteristic if a stripline pattern and a filter pattern are formed on a dielectric substrate of a low dielectric constant in a BPF according to the present invention.

FIG. 8*a* illustrates a graph where dielectric substrates 500, 510 and 520 each having a low dielectric constant of 7.8 are formed with areas of the stripline pattern 540 and the filter pattern 550, the same areas as those of FIG. 5, from which a transfer characteristic of the filter pattern 550 to which the stripline pattern 540 is connected is measured.

Figure 8B:
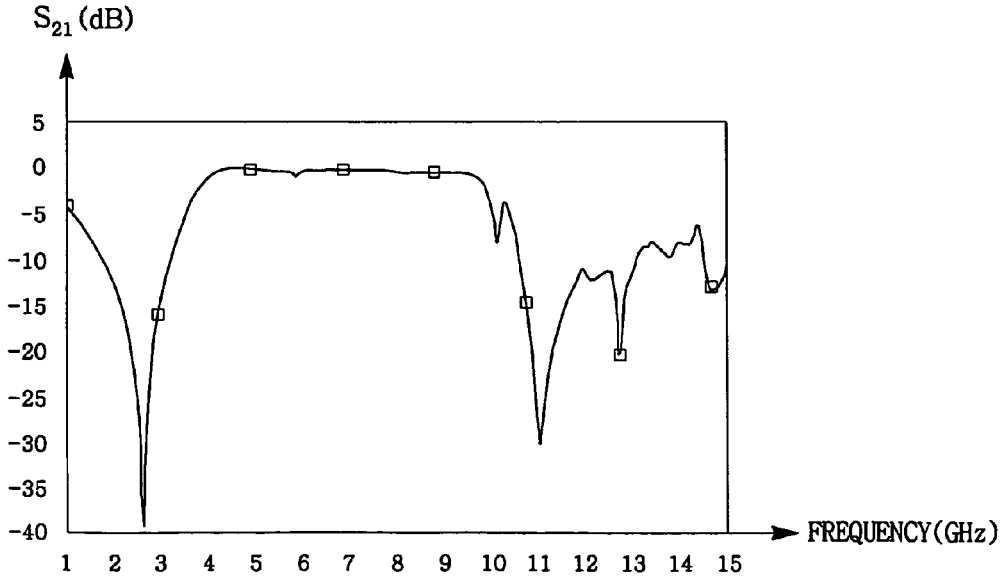
FIG. 8*b* is a graph illustrating a measurement of a transfer characteristic if a stripline pattern and a filter pattern are formed in reduced sizes on a dielectric substrate of a high dielectric constant in a BPF according to the present invention.

FIG. 8*b* illustrates a graph where dielectric substrates 500, 510 and 520 each having a high dielectric constant are formed with areas of the stripline pattern 540 and the filter pattern 550, the areas reduced by approximately ¼ of those of FIG. 5, from which a transfer characteristic of the filter pattern 550 to which the stripline pattern 540 is connected is measured.

Now, referring to FIGS. 8*a* and 8*b*, there was little decrease of transfer characteristic of the filter pattern 550 to which the stripline pattern 540 is connected, even if the areas were reduced while the dielectric constant of the dielectric substrates 500, 510 and 520 stayed high.

In case the input and output coupled line patterns 570 and 580 are formed using a high dielectric constant of the fourth dielectric substrate 530, the thickness of the fourth dielectric substrate 530 becomes much thinner to make it difficult to form the first and second stripline patterns 571 and 573, and the third and fourth stripline patterns 581 and 583. Furthermore, in case the first and second stripline patterns 571 and 573, and the third and fourth stripline patterns 581 and 583 are bent along the peripheral margin of the filter pattern 550, areas taken up by these patterns are very small. Therefore, it is preferred that the fourth dielectric substrate 530 be used of a high dielectric constant.

Figure 9:
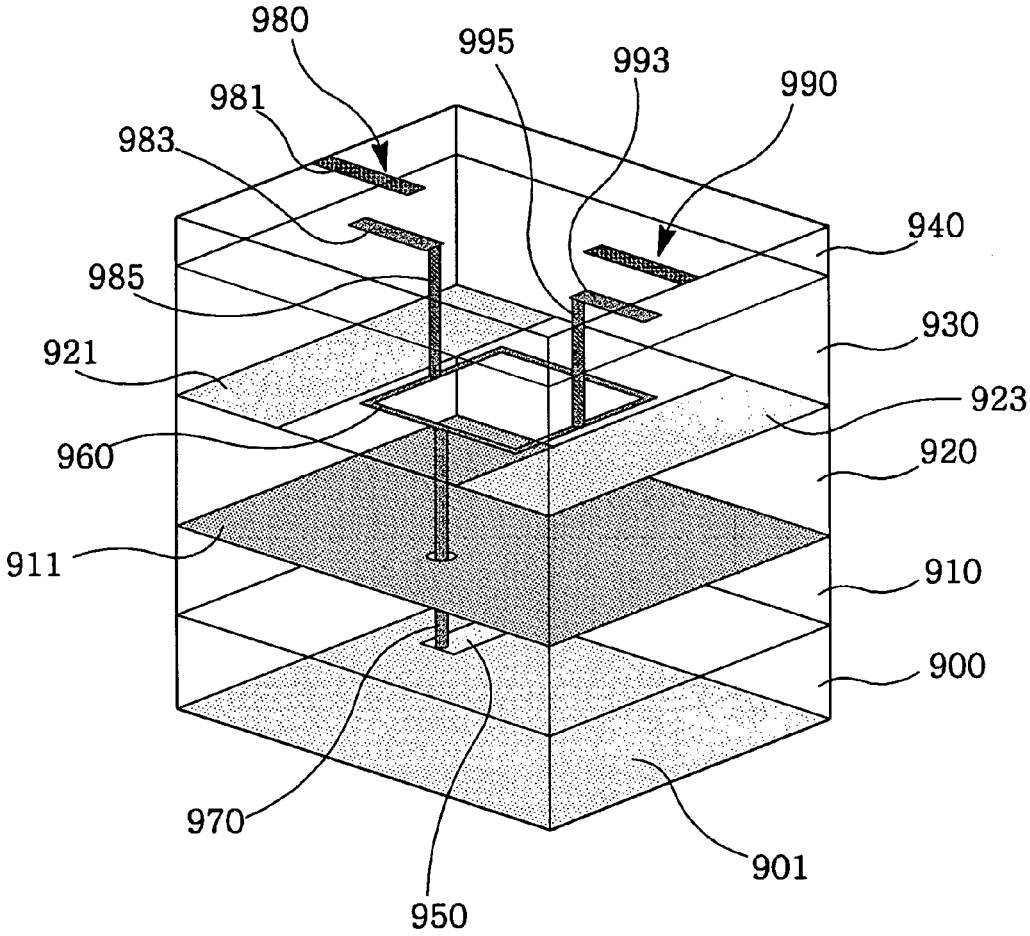
FIG. 9 is a perspective view of a construction of a BPF according to a third embodiment of the present invention.

FIG. 9 illustrates a still another embodiment of BPF where the input and output coupled line patterns are formed on a dielectric substrate of a low dielectric constant, while the filter pattern and stripline pattern are formed on a dielectric substrate of a high dielectric constant.

Referring to FIG. 9, first to fifth dielectric substrates 900, 910, 920, 930 and 940 are sequentially stacked up. For example, the first to third dielectric substrates 900, 910 and 920 are used of a high dielectric constant of 40, while the fourth and fifth dielectric substrates 930 and 940 are used of a low dielectric constant of 7.8.

The first dielectric substrate 900 is formed at a bottom surface thereof with a first ground pattern 901, and the second dielectric substrate 910 is formed at an upper surface thereof with a second ground pattern 911. A stripline pattern 950 is disposed between the first and second dielectric substrates 900 and 910.

The third dielectric substrate 920 is formed thereon with a filter pattern 960, and the filter pattern 960 is connected to the stripline pattern 950 through a via 970. The third dielectric substrate 920 is formed at left and right sides of the upper surface thereof with ground patterns 921 and 923.

The fifth dielectric substrate 940 is formed with an input and output coupled line patterns 980 and 990. The input coupled line pattern 980 is formed with first and second stripline patterns 981 and 983 in order to have an overlapping area between an upper surface and a bottom surface of the fifth dielectric substrate 940, and the second stripline pattern 983 is connected to the filter pattern 960 through a via 985. The output coupled line pattern 990 is formed with third and fourth stripline patterns 991 and 993 in order to have an overlapping area between the upper surface and the bottom surface of the fifth dielectric substage 950, and the second stripline pattern 993 is connected to the filter pattern 960 through a via 995.

In the still another embodiment of the present invention thus constructed, the BPF is configured in such a fashion that the stripline pattern 950 and the filter pattern 960 are formed at the first to third dielectric substrates 900, 910 and 920 each having a high dielectric constant, and the input and output coupled line patterns 980 and 990 are formed at the fourth and fifth dielectric substrates 930 and 940 each having a low dielectric constant.

Therefore, it is possible to form small sized stripline pattern 950, filter pattern 960, and the input and output coupled line patterns 980 and 990, such that the overall size of the BPF can be formed in small size as in the embodiment of FIG. 5.

Furthermore, if the input and output coupled line patterns 980 and 990 of FIG. 9 are formed bent as shown in the embodiment of FIG. 7, the overall size of the BPF can be much further reduced.

While the invention has been described by way of examples and in terms of preferred embodiments, it is to be understood that the invention is not limited to the disclosed embodiments. To the contrary, it will be apparent to those skilled in the art that various modifications and variations can be made in the present invention provided they come within the scope of the appended claims and their equivalents. Therefore, the scope of the appended claims should be accorded the broadest interpretation so as to encompass all such modifications and similar arrangements.

As apparent from the foregoing, a bandpass filter capable of filtering signals of ultra wide bands and whose overall size is much reduced can be formed using a stacking process where patterns are stacked in 3-D structures on a plurality of dielectric substrates.

Furthermore, input and output terminals where signals of the bandpass filter are inputted and outputted are embodied by input and output coupled line patterns such that widths of the stop band and passband through which signals of the bandpass filter are filtered can be widened.

Still furthermore, stripline patterns and filter patterns are formed on dielectric substrates each having a high dielectric constant, the input and output coupled line patterns are formed on dielectric substrates each having a low dielectric constant, and the input and output coupled line patterns are formed to be bent, thereby enabling to markedly reduce the overall size of the bandpass filter.

What is claimed is:

1. A bandpass filter (BPF) comprising:

a first, a second, a third and a fourth dielectric substrate each sequentially stacked;

a first around pattern printed on a bottom surface of the first dielectric substrate;

a stripline pattern formed between the first dielectric substrate and the second dielectric substrate and operated as a stub;

a second ground pattern formed between the second dielectric substrate and the third dielectric substrate;

a filter pattern formed on a top surface of the fourth dielectric substrate and connected to the stripline through a via;

an input coupled line filter formed on a top surface and a bottom surface of one side of the fourth dielectric substrate for transmitting to the filter pattern a signal inputted from outside to be filtered; and an output coupled line filter formed on a top surface and a bottom surface of the other side of the fourth dielectric substrate for outputting to the outside the signal filtered by the filter pattern.

2. The BPF as defined in claim 1, wherein the input coupled line filter is formed with first and second stripline patterns in order to have an overlapping area between an upper surface and a bottom surface of the fourth dielectric substrate.

3. The BPF as defined in claim 2, wherein frequencies of passbands are adjusted by altering a width and length of an area where the first and second stripline patterns are mutually overlapped.

4. The BPF as defined in claim 1, wherein the output coupled line filter is formed with third and fourth stripline patterns in order to have an overlapping area between an upper surface and a bottom surface of the fourth dielectric substrate, and the third stripline pattern is connected to the filter pattern.

5. The BPF as defined in claim 4, wherein frequencies of passbands are adjusted by altering the line width and length of an area where the third and fourth stripline patterns are mutually overlapped.

6. The BPF as defined in claim 1, wherein the input and output coupled line patterns are formed to be bent along a peripheral margin of the filter pattern.

7. The BPF as defined in claim 1, wherein the first to third dielectric substrates are the ones each having a high dielectric constant, while the fourth dielectric substrate is the one having a low dielectric constant.

8. A BPF comprising:

a first, a second, a third, a fourth and fifth dielectric substrate each sequentially stacked;

a first ground pattern printed on a bottom surface of the first dielectric substrate;

a strip line pattern formed between the first dielectric substrate and the second dielectric substrate, and operated as a stub;

a second ground pattern formed between the second dielectric substrate and the third dielectric substrate;

a filter pattern formed on a top surface of the third dielectric substrate and connected to the stripline through a via;

a ground pattern formed on left and right sides of the filter pattern;

an input coupled line filter formed on a top surface and a bottom surface of one side of the fifth dielectric substrate for transmitting a signal to be filtered and inputted from outside; and an output coupled line filter formed on a top surface and a bottom surface of the other side of the fifth dielectric substrate and connected to the filter pattern for outputting to the outside the signal filtered by the filter pattern.

9. The BPF as defined in claim 8, wherein the input and output coupled line filters are formed with first and second stripline patterns having an overlapping area between an upper surface and a bottom surface of the fifth dielectric substrate, and third and fourth stripline patterns, and the second and fourth stripline patterns are connected to the filter pattern through a via.

10. The BPF as defined in claim 9, wherein frequencies of passbands are adjusted by line width and length of an area overlapped by the first and second stripline patterns, and the third and fourth stripline patterns.

11. The BPF as defined in claim 8, wherein the input and output coupled line filters are formed to be bent.

12. The BPF as defined in claim 8, wherein the first to third dielectric substrates are the ones each having a high dielectric constant, while the fourth and fifth dielectric substrates are the ones each having a low dielectric constant.

* * * * *